United States Patent [19]

Fujiu et al.

[11] 4,286,958

[45] Sep. 1, 1981

[54] METHOD OF DYEING CELLULOSE FIBER-CONTAINING STRUCTURES

[75] Inventors: Takahiro Fujiu, Funabashi; Masao Nakajima, Tokyo; Shigeru Okano, Musashino, all of Japan

[73] Assignee: Toppan Printing Co., Ltd., Japan

[21] Appl. No.: 87,923

[22] Filed: Oct. 25, 1979

[30] Foreign Application Priority Data

| | | | |
|---|---|---|---|
| Nov. 1, 1978 | [JP] | Japan | 53/135086 |
| Jan. 24, 1979 | [JP] | Japan | 54/7525 |
| May 11, 1979 | [JP] | Japan | 54/47867 |
| May 15, 1979 | [JP] | Japan | 54/59363 |
| Jun. 15, 1979 | [JP] | Japan | 54/74269 |
| Aug. 24, 1979 | [JP] | Japan | 54/107897 |

[51] Int. Cl.[3] ..... C09B 62/00

[52] U.S. Cl. ..... 8/471; 8/542; 8/654; 8/657; 8/918

[58] Field of Search ..... 8/54.2, 2.5 A, 471, 8/542, 918

[56] References Cited

U.S. PATENT DOCUMENTS

| | | | |
|---|---|---|---|
| 1,679,480 | 8/1928 | Leemann et al. | 8/66 |
| 4,113,431 | 9/1978 | Terada | 8/40 |
| 4,142,853 | 3/1979 | Terada et al. | 8/471 |

FOREIGN PATENT DOCUMENTS

| | | |
|---|---|---|
| 2643994 | 8/1977 | Fed. Rep. of Germany . |
| 241854 | 2/1926 | United Kingdom . |
| 233704 | 6/1926 | United Kingdom . |
| 1441203 | 6/1976 | United Kingdom . |

OTHER PUBLICATIONS

Textile Printing Note 17 (Japan), 1978, vol. 30, (No. 13), pp. 129–130.

Heuser et al., J. Amer. Chem. Soc., 1950, 72, pp. 670–674.

Schwenker et al., Textile Research Journal, 1962, 32 (No. 9), pp. 797–804.

Schwenker et al., Textile Research Journal, 1963, 33 (No. 2), pp. 107–117.

*Primary Examiner*—A. Lionel Clingman

*Attorney, Agent, or Firm*—Bacon & Thomas

[57] ABSTRACT

This invention provides a method of dyeing a fibrous structure containing cellulose fibers. The method includes the steps of impregnating the fibrous structure with an alkaline compound in an amount of from 1 to 20% by weight based on the weight of the fibrous structure and with a modifying agent, the molar ratio of the alkaline compound to the modifying agent being 0.1 to 2.0, and the modifying agent being a compound of the formula where X is —H, —$NO_2$, —$CH_3$, or —$SO_2Cl$; effecting chemical modification of the impregnated fibrous structure by heat-treating it under steaming or dry heating conditions; and then dyeing the modified fibrous structure with a dye such as a disperse dye.

15 Claims, 4 Drawing Figures

METHOD OF DYEING CELLULOSE FIBER-CONTAINING STRUCTURES

Figure 1:
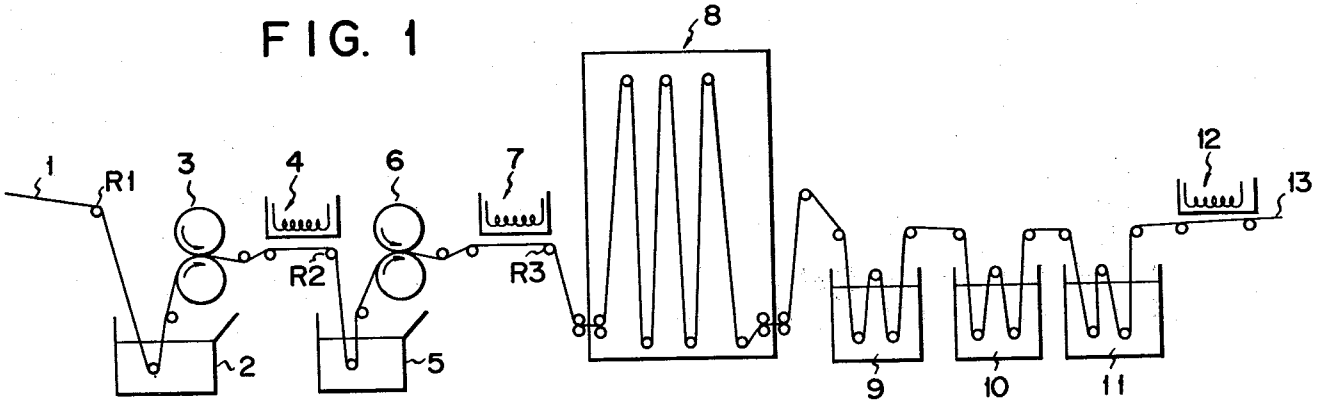

This invention relates to a method of dyeing cellulose fibers and fiber structures containing them.

Many attempts have heretofore been made to achieve a satisfactory dyeing of cellulose fibers with those dyestuffs, such as disperse dyes, which are inherently lacking in affinity for cellulose fibers or to achieve a uniform dyeing of blended cloths comprising cellulose fibers and synthetic fibers. The number of such attempts has been increasing with the development of the sublimation transfer printing technique using disperse dyes.

The method of dyeing cellulose fibers and fiber structures containing them with disperse dyes must meet the following requirements:

(a) Deeply colored designs can be obtained.

(b) The dyed designs have excellent color fastness, for example, to washing.

(c) The characteristic properties (such as moisture absorption properties, feeling, etc.) inherent to cellulose fibers are not impaired.

(d) The entire dyeing process can be completed in a reasonably short time.

(e) No harmful influences are exerted on the personnel or the equipment.

(f) No complicated apparatus or devices are required.

It is well known that the affinity of cellulose fibers for dyestuffs such as disperse dyes can be enhanced by esterification of the cellulose fibers. However, such esterification has heretofore been effected by the use of acylating agents such as acetylating agents and benzoylating agents. One typical procedure is to esterify a cellulose fiber with an acetylating agent or benzoylating agent and then subject it to transfer printing. However, acetylating agents and benzoylating agents have an irritating odor and tend to undergo hydrolysis during long-term storage in air, so that the esterification reaction must be carried out by the batch process or other similar processes. Moreover, cellulose fibers treated with an acetylating agent have the disadvantage of being poor in color fastness to washing.

On the other hand, a dyeing process involving the tosylation of a cellulose fiber is disclosed in Japanese Patent Laying-open Publication No. 18778/'75. This process comprises the steps of esterifying a cellulose fiber with a tosylating agent such as p-toluenesulfonyl chloride and then dyeing it with a disperse dye. The only description found in Example 4 is as follows: "A mercerized and bleached cotton fabric was soaked in a 50% (w/w) p-toluenesulfonyl chloride solution, squeezed, allowed to stand at room temperature for 24 hours, rinsed with acetone, washed with water, and then dried. The cotton fabric subjected to this pretreatment had a degree of substitution of 0.2–0.4. A paper substrate coated entirely with a sublimable disperse dye was applied to the cotton fabric, and the dye was transferred by pressing at 200° C. for 20 seconds." However, the necessity of allowing the cotton fabric to stand for 24 hours makes this process quite impractical.

The chemical modification of cellulose by the use of p-toluenesulfonyl chloride is also described in various publications. See, for example, the *Journal of American Chemical Society,* Vol. 72, pp. 670–674 (1950); *Textile Research Journal,* Vol. 32, pp. 797–804 (1962); and *Textile Research Journal,* Vol. 33, pp. 107–117. However, the processes described therein are not suitable for industrial purposes because they require a long reaction time and/or reagents difficult to handle.

Thus, no prior art processes enables one to effect the tosylation of cellulose fibers in a short time, particularly for dyeing purposes.

In the case of acylation, a process which permits a cellulose fiber to be chemically modified in a short time is disclosed in Japanese Patent Laying-open Publication No. 96298/'77. More specifically, "a process for the modification of a cellulose fiber-containing cloth wherein the cellulose fiber is continuously esterified by impregnating the cloth with an alkaline solution having a concentration of from 2 to 7%, absorbing thereon an esterifying agent in an amount of from 15 to 40% by weight based on the weight of the cloth, and then steaming it or allowing it to stand at room temperature for a period of time ranging from 10 to 120 seconds" is described and claimed therein. However, since the amount of alkaline compound used in the process is from 0.6 to 4.2% by weight based on the weight of the cloth, it is quite impossible to substitute a tosylating agent for the acylating agent used in this process. Under these conditions, the proportion of the alkaline compound to the tosylating agent is so low that the esterification reaction will not take place or, even if it takes place, the properties of the cellulose fiber will be too much impaired for practical use.

The present invention has been completed in view of the above-described circumstances. It is therefore the primary object of the present invention to provide a method of dyeing cellulose fiber-containing structures which method enables one to achieve a simple and satisfactory dyeing of cellulose fibers without imparing the characteristic properties thereof and to obtain dyed products having excellent color fastness to washing.

According to the present invention, there is provided a method of dyeing a fiber structure composed of a cellulose fiber or a blend of a cellulose and a synthetic fiber which comprises the steps of impregnating the fiber structure with an alkaline compound in an amount of from 1 to 20% by weight based on the weight of the fiber structure and with a modifying agent, the molar ratio of the alkaline compound to the modifying agent (the alkaline compound/the modifying agent) being 0.1 to 2.0, and the modifying agent being a compound of the formula

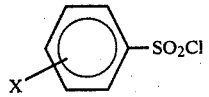

where X is —H, —$NO_2$, —$CH_3$, or —$SO_2Cl$; effecting chemical modification of the impregnated fiber structure by heat-treating it under steaming or dry heating conditions; and then dyeing the modified fiber structure with a dye selected from the group consisting of a disperse dye, an oil-soluble dye, a mordant dye, and a basic dye.

Figure 2:
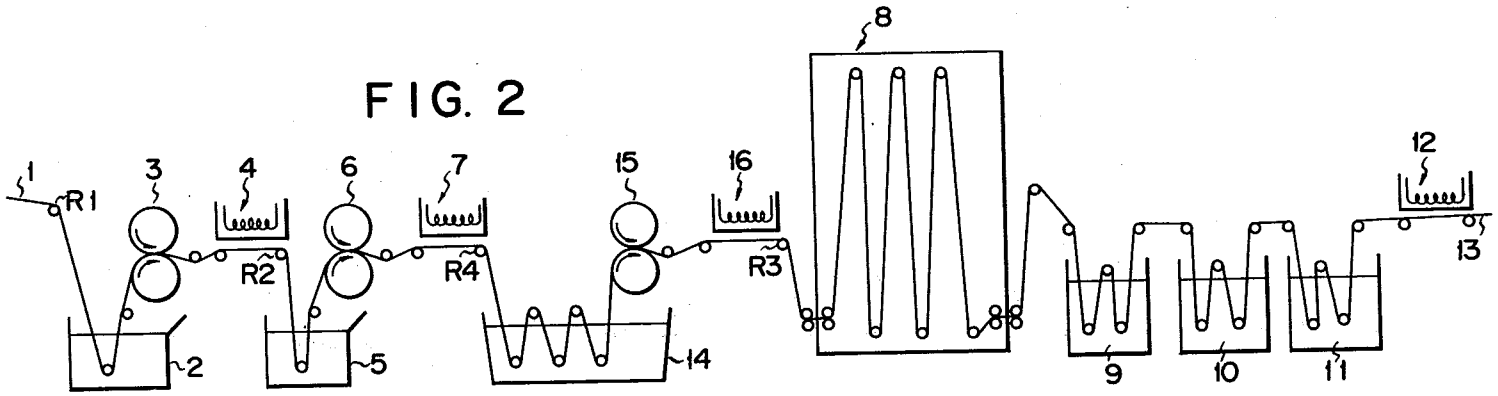
Figures 3, 4:
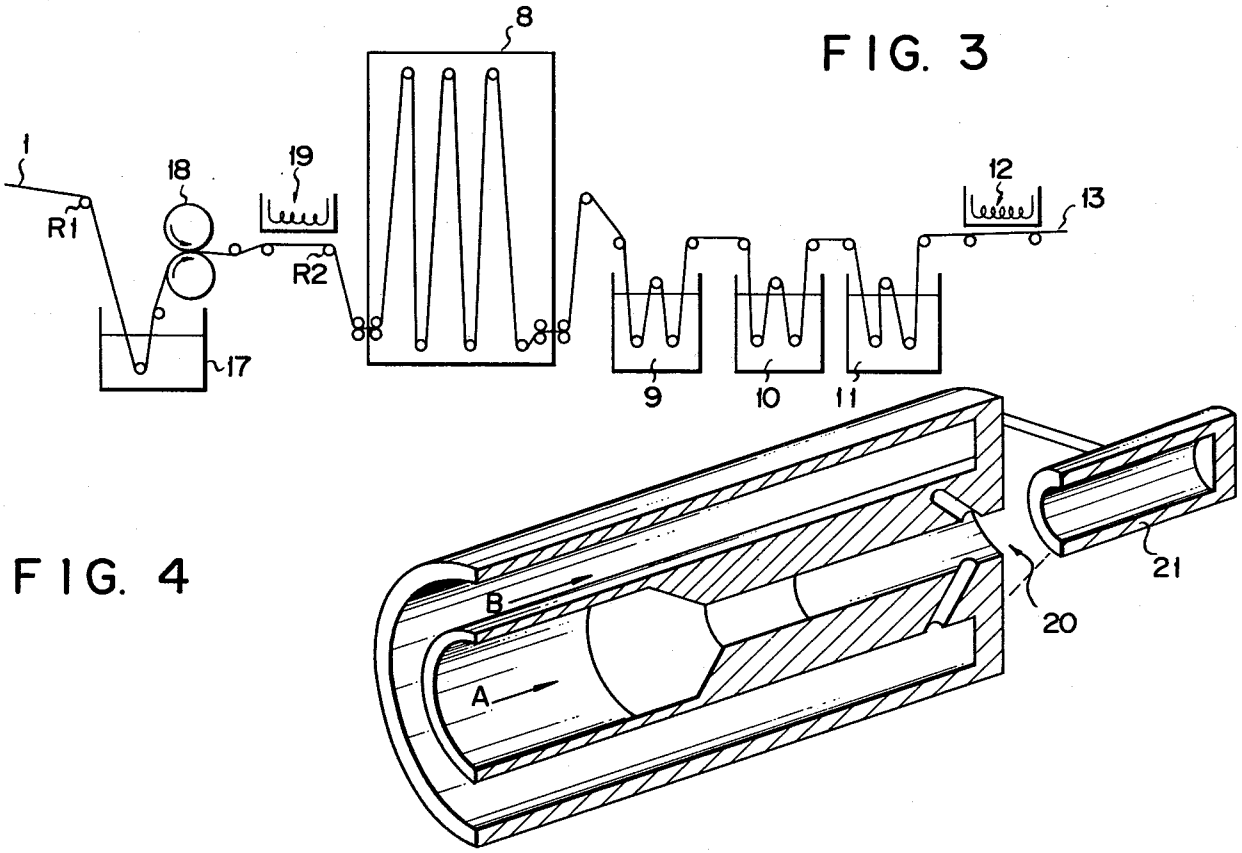

This invention can be more fully understood from the following detailed description when taken in conjunction with the accompanying drawings, in which:

FIGS. 1 to 3 are schematic illustrations of several systems for carrying out the tosylation process of the present invention; and FIG. 4 is a partially cutaway perspective view of a sonic nozzle.

The present invention will hereinafter be described in detail.

1. Fiber Structure

The fiber structures which can be dyed by the method of the present invention may be composed of natural cellulose fibers such as cotton, regenerated cellulose fibers such as viscose rayon, or blends of such cellulose fibers and synthetic fibers such as polyester. It is of course that they may be not only in the form of cloth but also in the form of yarn or thread.

2. Modifying Agent

The modifying agent which is used in the method of the present invention is a compound of the formula

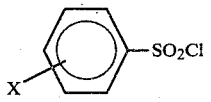

where X is —H, —$NO_2$, —$CH_3$, or —$SO_2Cl$. Specific examples of this compound include p-toluenesulfonyl chloride, o-toluenesulfonyl chloride, m-toluenesulfonyl chloride, benzenesulfonyl chloride, o-nitrobenzenesulfonyl chloride, m-nitrobenzenesulfonyl chloride, p-nitrobenzenesulfonyl chloride, toluene-3,4-disulfonyl chloride, and the like.

3. Alkaline Compound

The alkaline compound which is used in the method of the present invention may be selected from the hydroxides and alcoholates of alkali metals (such as lithium, sodium, potassium, etc.) or alkaline earth metals (such as beryllium, magnesium, calcium, barium, strontium, etc.); the carbonates and bicarbonates of alkali metals or alkaline earth metals; the salts derived from weak acids and strong or weak bases, including the acetates, formates, lactates, stearates, sulfites, cyanates, isocyanates, and thiocyanates of alkali metals; the phosphates of alkali metals; and the like.

4. Impregnation with Modifying Agent and Alkaline Compound

The fiber structure may be impregnated with a modifying agent (or tosylating agent) and an alkaline compound in any desired order. This can be done, for example, by soaking the fiber structure in their respective solutions. The amount of alkaline compound incorporated in the fiber structure should be from 1 to 20% by weight based on the weight of the fiber structure, and the amount of modifying agent (or tosylating agent) should be from 10.0 to 0.5 moles per mole of the alkaline compound. Special care must be taken to keep within these limits. If the amount of alkaline compound incorporated in the fiber structure is less than 1% by weight or greater than 20% by weight, any favorable results cannot be obtained, even if the molar ratio of alkaline compound to modifying agent (or tosylating agent) incorporated in the fiber structure is kept within the range of from 0.1 to 2.0. More specifically, the degree of chemical modification will fail to reach a level required for satisfactory dyeing or an unnecessarily large amount of the alkaline compound will be wasted in such cases.

It is generally known that the reaction of cellulose with a modifying agent (or tosylating agent) as defined above takes place most easily when the cellulose is in a swollen state, or in the form of an alkali cellulose. It is also known that, when cellulose is reacted with an alkaline compound such as sodium hydroxide or pottasium hydroxide, no alkali cellulose is formed before the amount of alkaline compound used reaches a certain level. As described in "Encyclopaedia Chimica" (Kyoritsu Publishing Co.), Vol. 1, p. 365, cellulose can be converted into different types of alkali cellulose by soaking it in aqueous solutions containing sodium hydroxide at various concentrations. More specifically, sodium cellulose I which differs in crystal shape from cellulose on the basis of X-ray diffraction analysis is formed when the concentration of sodium hydroxide in the aqueous solutions is from 9 to 12%, and sodium cellulose II which differs in crystal shape from cellulose and sodium cellulose I on the basis of X-ray diffraction analysis is formed when the concentration of sodium hydroxide is from 12 to 20%. Thus, in order to facilitate the reaction of cellulose with a modifying agent (or tosylating agent), the fiber structure is preferably impregnated with an alkaline compound in an amount greater than a certain level. In the method of the present invention, the amount of alkaline compound incorporated in the fiber structure should be from 1 to 20% by weight and preferably from 4 to 20% by weight based on weight of the fiber structure. The present inventors have experimentally demonstrated that the best results can be obtained when the amount of alkaline compound incorporated in the fiber structure is within the range of from 4 to 20% by weight and the molar ratio of alkaline compound to modifying agent (or tosylating agent) incorporated in the fiber structure is within the range of from 0.1 to 2.0.

By way of example, the fiber structure may be impregnated according to any one of the following four procedures:

(i) The fiber structure is soaked in an aqueous solution of an alkaline compound, squeezed, and then dried. Thereafter, it is soaked in an organic solvent solution of a modifying agent (or tosylating agent), squeezed, and dried.

(ii) The fiber structure is soaked in an organic solvent solution of a modifying agent (or tosylating agent), squeezed, and then dried. Thereafter, it is soaked in an aqueous solution of an alkaline compound, squeezed, and then dried.

(iii) The fiber structure is soaked in an aqueous solution of an alkaline compound having a relatively high concentration, squeezed, and then dried. Thereafter, it is soaked in an organic solvent solution of a modifying agent (or tosylating agent), squeezed, and then dried. Moreover, it is soaked in an aqueous solution of the alkaline compound having a relatively low concentration. According to this procedure, the alkaline compound is seemingly incorporated to excess. However, as a result of the three soaking steps, the amount of alkaline compound incorporated actually in the fiber structure is kept within the range of from 1 to 20% by weight. It has been experimentally demonstrated that, unlike the alkaline compound incorporated in the fiber structure for the first time, the alkaline compound incorporated for the second time promotes the tosylation reaction and possibly has a catalytic activity.

(iv) An alkaline compound or a modifying agent (or tosylating agent) or both are microcapsulated, and they are dissolved or dispersed in a solvent. Subsequently, the fiber structure is soaked in the resulting fluid, squeezed, and then dried. According to this procedure, the alkaline compound and the modifying agent (or tosylating agent) may be present in an identical bath and, therefore, the fiber structure can simultaneously impregnated with both of them in a single step.

5. Heat Treatment

Where the heat treatment is carried out under steaming conditions, good results can be obtained by treating the impregnated fiber structure with normal-pressure saturated steam or superheated steam at a temperature of from 100° to 180° C. for high-pressure saturated steam at a temperature of from 100° to 140° C. for a period of time ranging from 30 seconds to 20 minutes. Where the heat treatment is carried out under dry heating conditions, relatively good results can be obtained by baking the impregnated fiber structure at a temperature of from 60° to 180° C. for a period of time ranging from 30 seconds to 20 minutes. The present inventors have experimentally demonstrated that steaming produces better results than dry heating. The reason for this seems to be that steaming permits the tosylation reaction to proceed more effectively because the fiber structure impregnated first with an alkaline compound and then with a modifying agent (or tosylating agent) is tosylated while being kept in a swollen state. The same is true of the fiber structure impregnated first with a modifying agent (or tosylating agent) and then with an alkaline compound. Again, steaming permits the tosylation reaction to proceed more effectively, possibly because of its more powerful swelling effect on cellulose.

6. Dyeing

The dyestuffs which can be used in the method of the present invention include disperse dyes, oil-soluble dyes, mordant dyes, basic dyes, and vat dyes, whether they are sublimable or not. The fiber structure may be dyed by direct or transfer printing as well as by dip dyeing. Among others, the sublimation transfer printing process is feasible when a sublimable dyestuff is used.

7. System

FIGS. 1 to 3 are schematic illustrations of several systems for carrying out the tosylation process of the present invention.

The system shown in FIG. 1 is based on the aforesaid procedure 4-(i) or 4-(ii). A fiber structure (hereinafter referred to as a cloth) 1 composed of a cellulose fiber or a blend of a cellulose fiber and a synthetic fiber is introduced via a lead roll $R_1$ into an alkaline compound treating bath 2, squeezed by means of squeeze rolls 3 so that a predetermined amount of the alkaline compound may be incorporated in the cloth 1, and then dried in a dryer (or pin tenter oven) 4. Thereafter, the cloth 1 is introduced via a lead roll $R_2$ into a tosylating agent treating bath 5, squeezed by means of squeeze rolls 6 so that a predetermined amount of the tosylating agent may be incorporated in the cloth 1, and then dried in a dryer 7. The cloth 1 thus impregnated is introduced via a lead roll $R_3$ into a continuous loop steamer 8 where it is subjected to steaming, passed successively through a water bath (or hot water bath) 9, a soaping bath 10, and another water bath 11, and then dried in a dryer (or pin tenter oven) 12 to obtain a chemically modified cloth 13. However, the alkaline compound treating bath 2 and the tosylating agent treating bath 5 are interchanged in a system based on the aforesaid procedure 4-(ii).

The system shown in FIG. 2 is based on the aforesaid procedure 4-(iii). This system is the same as that of FIG. 1 except that, after being dried in the dryer 7, the cloth 1 is introduced via a lead roll $R_4$ into another alkaline compound treating bath (or catalyst treating bath) 14, squeezed by means of squeeze rolls 15, and then dried in a dryer (or pin tenter oven) 16.

The system shown in FIG. 3 is based on the aforesaid procedure 4-(iv). In this system, the cloth 1 is simultaneously impregnated with an alkaline compound and a tosylating agent by introducing it into a single bath 17. When compared with the system of FIG. 1, that of FIG. 3 is simplified because the two sets of baths 2, 5 and associated squeeze rolls 3, 7 and dryers 4, 7 are replaced by a single set of bath 17 and associated squeeze rolls 18 and dryer 19.

In carrying out the tosylation process of the present invention, hydrogen chloride may be evolved during the heat treatment. It is well known that hydrogen chloride (or hydrochloric acid) not only has strong acid properties but also exerts a powerful corrosive action on metals including ordinary types of stainless steel which are considered to be relatively resistant to corrosion. Accordingly, if the tosylation process of the present invention is carried out by means of process machines, such as steamers and dryers, which are currently used for dyeing, finishing, and scouring purposes, these process machines are liable to corrosion or damage. Moreover, if a large amount of hydrogen chloride is evolved during the tosylation reaction, the cloth may also be deteriorated to an undue extent. Thus, it is desirable to remove or inactivate the hydrogen chloride which is evolved as a by-product of the tosylation reaction and has such detrimental effects.

One possible measure for the solution of this problem is to impregnate the cloth with an excessive amount of an alkaline compound and neutralize the hydrogen chloride therewith immediately after its evolution. However, as stated before, the resulting molar ratio of alkaline compound to tosylating agent present in the cloth may be so unbalanced that the tosylation reaction fails to proceed.

The present inventors have found that this problem can be solved by heat-treating the impregnated in the presence of a compound capable of inactivating hydrogen chloride.

The compound capable of inactivating hydrogen chloride may be present in the alkaline compound treating bath (2), the tosylating agent treating bath (5), the catalyst treating bath (14), or the bath (17) in which both the alkaline compound and the tosylating agent are dissolved or dispersed (so that the fiber structure may be impregnated with it simultaneously with the coexisting substance or substances), or may be present in a separate bath.

The expression "compound capable of inactivating hydrogen chloride", as used herein, comprehends the compounds which can trap the evolved hydrogen chloride without playing any important role in the tosylation reaction and the compounds which do not trap the evolved hydrogen chloride but can significantly retard the corrosion of metals in the presence of hydrogen chloride.

The compounds capable of inactivating hydrogen chloride, which are useful in the practice of the present invention, include metallic soaps, organotin compounds, epoxy compounds, and organic amines. The useful metallic soaps can be represented by the formulas $$M(OOCR)_2$$

and $$Al(OOCR)_2OH$$

where M is a metal such as Ca, Ba, Zn, Sn, Mg, Cd, or Pb and R is an alkyl group. Specific examples of these metallic soaps are cadmium stearate, cadmium laurate, cadmium ricinoleate, cadmium naphthenate, cadmium 2-ethylhexoate, barium stearate, barium laurate, barium ricinoleate, barium naphthenate, barium 2-ethylhexoate, calcium stearate, calcium ricinoleate, strontium stearate, zinc stearate, zinc laurate, zinc ricinoleate, zinc 2-ethylhexoate, lead stearate, dibasic lead stearate, lead naphthenate, tin stearate, aluminum stearate, magnesium stearate, and the like.

The useful organotin compounds can be represented by the formula

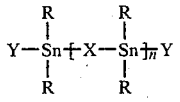

where n is zero or a positive integer, R is an alkyl group, Y is $R_1COO$—, $R_2OOC$—C=C—COO—, $R_3S$—, or $R_4OOC$—$CH_2$—S—, and $R_1$, $R_2$, $R_3$, and $R_4$ are alkyl groups. Specific examples of these organotin compounds are monobutyltin trimethylmaleate, monobutyltin trioctylmaleate, dibutyltin dilaurate, dibutyltin laurate methylmaleate, dibutyltin dioleylmaleate, dibutyltin dimethylmaleate, dibutyltin maleate, dibutyltin methoxymethylmaleate, a mixture of dibutyltin dimaleate and dibutyltin dimethylmaleate, dibutyltin dioctylmaleate, dibutyltin dioctylthioglycolate, dibutyltin dilauryl-mercaptide, tribenzyltin octylmaleate, tribenzyltin trimethylmaleate, and the like.

The useful epoxy compounds can be represented by the formulas

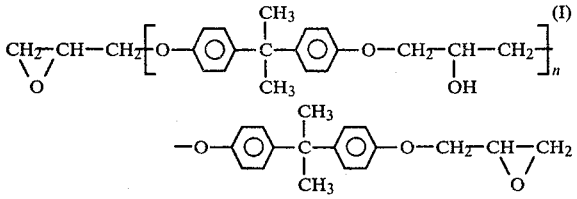

(I)

where n is zero or a positive integer;

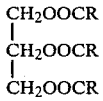

(II)

where R is an alkyl group containing an epoxy ring;

RCOOR′ (III)

where R is an alkyl group containing an epoxy ring, and R′ is an alkyl group;

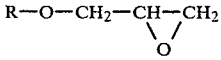

(IV)

where R is an alkyl or an aryl group; and

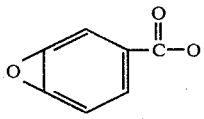

(V)

where R is an alkyl group. Specific examples of these epoxy compounds are alkyl glycidyl ethers such as butyl glycidyl ether, aryl glycidyl ethers such as phenyl glycidyl ether, epichlorohydrin-bisphenol A polymer, epoxidized soybean oil, epoxidized linseed oil, butyl epoxystearate, epoxidized diacetomonoolein, 3,4-epoxycyclohexanecarboxylic acid esters, the 9,10-epoxystearic acid ester of 3,4-epoxycyclohexylmethanol, the 9,10-12,13-diepoxystearic acid ester of 3,4-epoxycyclohexylmethanol, the 3,4-epoxycyclohexanecarboxylic acid ester of 2-ethyl-1,3-hexanediol, di-2-ethylhexyl epoxyhexahydrophthalate, iso-octyl 9,10-epoxystearate, and the like.

Specific examples of the useful organic amines are ethylamine, diethylamine, dodecylamine, coconut oil alkylamine, tetradecylamine, hexadecylamine, octadecylamine, hardened beef tallow alkylamine, beef tallow alkylamine, oleylamine, dodecylmethylamine, coconut oil alkyldimethylamine, tetradecyldimethylamine, hexadecyldimethylamine, hardened beef tallow alkyldimethylamine, octadecyldimethylamine, beef tallow alkylpropylenediamine, hardened beef tallow alkylpropylenediamine, diamylamine, β-naphthylamine, phenylnaphthylamine, pyridine, quiniline, and the like.

It is generally known that ammonium salts of which the anionic component is non-oxidizing are thermally decomposed to produce ammonia. It is also possible to heat-treat the impregnated cloth in the presence of such an ammonium salt so that the hydrogen chloride evolved during the heat treatment may be neutralized and hence inactivated. Specific examples of these ammonium salts are ammonium carbonate, ammonium hydrogen carbonate, ammonium acetate, and the like.

It is to be understood that the aforesaid compounds may be used in combination so as to enhance their respective effects.

Where ammonia is used as the compound capable of inactivating hydrogen chloride, the impregnated cloth may be treated with steam to which ammonia is added. The sonic nozzle shown in FIG. 4 is useful for this purpose. Steam is supplied through a central bore as indicated by the arrow A, while aqueous ammonia is supplied through a peripheral annular bore as indicated by the arrow B. Both are mixed at the center of implosion 20, divided finely under the action of a resonator chamber 21 vibrating in resonance with sound waves, and then spouted. Since ammonia is practically insoluble in water at temperatures of the order of 100° C., the spouted amminia does not dissolve into the steam condensate contained in the cloth, but remains in the vapor phase to neutralize the evolved hydrogen chloride.

Prior to dyeing, the cloth thus modified may be subjected to a treatment for improving its dyeing properties. This can be done by any well known procedure. For example, the density, saturation, and depth of the color can further be enhanced by treating the modified cloth with a resin which is dyeable with disperse dyes and then subjecting it to sublimation transfer printing. Specific examples of the resin include amino-alkyd resin, polyamide, polyurethane, polyvinyl chloride, polyvinyl acetate, polyester, polyacrylate, polyacetal, polyvinyl alcohol, polyvinylidene chloride, polyvinyl acetal, polystyrol, polycarbonate, epoxy resin, and the like.

Moreover, the modified cloth may be treated with a textile cross-linking agent and a cross-linking catalyst to control its feeling and thereby achieve various types of finishing (such as hardening and softening). Specific examples of the textile cross-linking agent include dimethylolurea, dimethylolpropyleneurea, dimethyloldihydroxyethyleneurea, dimethyloluron, trimethylolmelamine, trimethoxymethylmelamine, hexamethoxymethylmelamine, dimethylolmethyltriazone, dimethylolethyltriazone, dimethylolhydroxyethyltriazone, dimethylolmethyl carbamate, dimethylolethyl carbamate, dimethylolhydroxyethyl carbamate, N-methylolacrylamide, methylolglyoxalmonourea, methylolglyoxaldiurea, formaldehyde, tetraoxane, glutaraldehyde, diepoxide, divinyl sulfone, 4-methoxy-5-dimethyldimethylolpropylenediurea, tetramethylolacetylenediurea, and the like. Specific examples of the cross-linking catalyst include organic acids such as acetic acid, maleic acid, etc.; ammonium salts such as ammonium chloride, ammonium sulfate, diammonium hydrogen phosphate, etc.; amines such as ethanolamine hydrochloride, 2-amino-2-methylpropanol hydrochloride, etc.; inorganic salts such as magnesium chloride, zinc nitrate, zinc chloride, magnesium nitrate, zinc borofluoride, aluminum chloride, magnesium phosphate, etc.; and the like.

The present invention is further illustrated by the following examples.

EXAMPLE 1

(1) Mercerized broad cloth composed of a 65/35 blend of polyester and cotton was soaked in an aqueous solution of 8% (w/w) sodium hydroxide for 30 seconds, squeezed by means of squeeze rolls to give a pickup of 100% and then dried by allowing it to reside in a pin tenter oven at 110° C. for 40 seconds. Thereafter, this cloth was soaked in a solution of 30%, (w/w) p-toluenesulfonyl chloride in acetone for 30 seconds, squeezed to give a pickup of 100%, and then air-dried. The molar ratio of sodium hydroxide to p-toluenesulfonyl chloride incorporated in the cloth was 1.27. The cloth thus impregnated was treated with normal-pressure saturated steam at 100° C. for 3 minutes, washed with water, soaped with marseilles soap, washed again with water, and then dried to obtain a modified cloth. When calculated according to the following equation (based on the weight increase method), the degree of substitution (D.S.) of this modified cloth was 0.21.

Degree of Substitution (D.S.)

$$= \frac{\left\{\left(\begin{matrix}\text{Weight of Cloth}\\ \text{After Treatment}\end{matrix}\right) - \left(\begin{matrix}\text{Weight of Cloth}\\ \text{Before Treatment}\end{matrix}\right)\right\} \times 162.08}{\left(\begin{matrix}\text{Weight of Cloth}\\ \text{Before Treatment}\end{matrix}\right) \times \left(\begin{matrix}\text{Cellulose Content of}\\ \text{Cloth Before Treatment}\end{matrix}\right) \times \frac{1}{100}} \times \frac{1}{\left(\begin{matrix}\text{Molecular Weight}\\ \text{of Tosyl Group}\end{matrix}\right) - 1}$$

where the degree of substitution (D.S.) in the average number of tosyl-substituted hydroxyl groups among the three hydroxyl groups present in each glucose unit of cellulose, the numerical value 162.08 is the molecular weight of each glucose unit, and the numerical value 1 is the atomic weight of hydrogen.

(2) A transfer paper was prepared by gravure printing of single starch-coated paper (having a basis weight of 60 g/m$^2$) with an ink having the following composition.

| (Ink Composition) Ingredient | Parts by Weight |
|---|---|
| Sumikalon Red E-FBL Power (a disperse dye manufactured by Sumitomo Chemicals Co. Japan) | 10 |

-continued

| (Ink Composition) Ingredient | Parts by Weight |
|---|---|
| Ethyl Cellulose N-7 (manufactured by Hercules Co.) | 9 |
| Nonionic Surfactant (polyoxyethylene alkylarylether). | 1 |
| Isopropyl Alcohol | 40 |
| Ethanol | 40 |

(3) The transfer paper described in the above paragraph (2) was superposed on the modified cloth described in the above paragraph (1), and transfer printing was carried out by the application of heat and pressure to them. More specifically, they were exposed to a temperature of 195° C. and a pressure of 300 g/cm$^2$ for 40 seconds. This resulted in a printed cloth of which both the polyester and the cotton portion showed a red color of the same density. According to the JIS A-2 method for the measurement of color fastness to washing, this printed cloth was rated 5 and thus found to have excellent color fastness to washing.

EXAMPLE 2

(1) Mercerized broad cloth composed of a 65/35 blend of polyester and cotton was soaked in a solution of 30% (w/w) p-toluenesulfonyl chloride in acetone for 30 seconds, squeezed by means of squeeze rolls to give a pickup of 100%, and then air-dried. Thereafter, this cloth was soaked in an aqueous solution of 8% (w/w) sodium hydroxide for 30 seconds, squeezed to give a pickup of 100%, and then dried by allowing it to reside in a pin tenter oven at 100° C. for 30 seconds. The molar ratio of p-toluenesulfonyl chloride to sodium hydroxide incorporated in the cloth was 0.79 and, hence, that of sodium hydroxide to p-toluenesulfonyl chloride was 1.27. The cloth thus impregnated was treated with normal-pressure saturated steam at 100° C. for 3 minutes, washed with water, soaped, washed again with water, and then dried to obtain a modified cloth. The degree of substitution (D.S.) of this modified cloth was 0.19.

(2) A transfer paper was prepared in the same manner as in Example 1.

(3) The transfer paper described in the above paragraph (2) was superposed on the modified cloth described in the above paragraph (1), and transfer printing was carried out by the application of heat and pressure to them. More specifically, they were exposed to a temperature of 195° C. and a pressure of 300 g/cm$^2$ for 40 seconds. This resulted in a printed cloth of which both the polyester and the cotton portion showed a red color of the same density, saturation, and depth.

EXAMPLE 3

(1) A transfer paper was prepared by gravure printing of single starch-coated paper (having a basis weight of 60 g/m$^2$) with inks having the following composition.

| (Ink Composition) Ingredient | Parts by Weight |
|---|---|
| Dye Power* | 10 |
| Ethyl Cellulose N-7 | 9 |
| Nonionic Surfactant (polyoxyethylene alkylarylether) | 1 |
| Isopropyl Alcohol | 40 |
| Ethanol | 40 |

* Yellow: C.I. Disperse Yellow 51
Red: C.I. Disperse Red 60
Blue: C.I. Disperse Blue 73
Black: Proper Mixture of Dyes (2) Mercerized cambric cloth (having a weight per unit area of 100 g/m$^2$) composed of a 65/35 blend of polyester and cotton was soaked in an aqueous solution of 10% (w/w) sodium hydroxide, squeezed uniformly to give a pickup of 100%, and then dried. Thus, 10% by weight of sodium hydroxide was incorporated in the cloth.

(3) This cloth impregnated with sodium hydroxide was soaked in acetone solutions containing p-toluenesulfonyl chloride at various concentrations, squeezed uniformly, and then dried to obtain a variety of impregnated cloths. The concentrations of p-toluenesulfonyl chloride in the acetone solutions were such that the molar ratio of sodium hydroxide to p-toluenesulfonyl chloride incorporated in the cloth varied from 0.05 to 2.5.

(4) These impregnated cloths were treated with normal-pressure saturated steam at 100° C. for 3 minutes, washed with water, soaped with marseilles soap, washed again with water, and then dried to obtain a variety of modified cloths.

(5) The transfer paper described in the above paragraph (1) was superposed on each of the modified cloths described in the above paragraph (4), and transfer printing was carried out by exposing them to a temperature of 195° C. and a pressure of 300 g/cm$^2$ for 35 seconds. Then, the density of each color was measured by means of a Macbeth reflection densitometer. The results thus obtained are summarized in the following table.

| NaOH/PTSC* | Yellow | Red | Blue | Black |
|---|---|---|---|---|
| Unmodified Cloth | 0.68 | 0.96 | 0.94 | 1.03 |
| 0.05 | 0.68 | 0.97 | 0.96 | 1.05 |
| 0.12 | 0.68 | 1.11 | 1.10 | 1.27 |
| 0.43 | 0.78 | 1.23 | 1.25 | 1.32 |
| 0.74 | 0.81 | 1.23 | 1.29 | 1.44 |
| 0.95 | 0.88 | 1.26 | 1.30 | 1.48 |
| 1.09 | 0.91 | 1.30 | 1.30 | 1.50 |
| 1.30 | 0.92 | 1.30 | 1.32 | 1.56 |
| 1.45 | 0.88 | 1.29 | 1.31 | 1.55 |
| 1.52 | 0.78 | 1.25 | 1.30 | 1.54 |
| 1.74 | 0.77 | 1.20 | 1.26 | 1.32 |
| 1.84 | 0.77 | 1.21 | 1.22 | 1.33 |
| 2.00 | 0.72 | 1.20 | 1.20 | 1.23 |
| 2.50 | 0.68 | 0.97 | 0.94 | 1.03 |

*The molar ratio of sodium hydroxide to p-toluenesulfonyl chloride incorporated in the cloth.

It can be seen from these data that, when the amount of sodium hydroxide incorporated in the cloth was fixed at 10% by weight, relatively good results were noted insofar as the molar ratio of sodium hydroxide to p-tolyenesulfonyl chloride was within the range of from 0.12 to 2.0. Among others, the most satisfactory printed cloth was obtained when the molar ratio was 1.30.

EXAMPLE 4

(1) Mercerized cambric cloth (having a weight per unit area of 100 g/m$^2$) composed of a 65/35 blend of polyester and cotton was soaked in aqueous solutions containing sodium hydroxide at various concentrations, squeezed uniformly to give a constant pickup, and then dried to obtain a variety of impregnated cloths. The concentrations of sodium hydroxide in the aqueous solutions were such that the amount of sodium hydroxide incorporated in the cloth varied from 1 to 25% by weight.

(2) These cloths impregnated with sodium hydroxide were soaked in acetone solutions containing p-tolyenesulfonyl chloride at various concentrations, squeezed uniformly, and then dried. The concentrations of p-toluenesulfonyl chloride in the acetone solutions were such that the molar ratio of sodium hydroxide to p-toluenesulfonyl chloride incorporated in the cloth was fixed at 1.30.

(3) These impregnated cloths were treated in the same manner as in the paragraph (4) of Example 3 to obtain a variety of modified cloths.

(4) The transfer paper described in the paragraph (1) of Example 3 was superposed on each of the modified cloths described in the above paragraph (3), and transfer printing was carried out in the same manner as in Example 3. Then, the density of each color was measured by means of a Macbeth reflection densitometer. The results thus obtained are summarized in the following table.

| Amount of NaOH* | Yellow | Red | Blue | Black |
|---|---|---|---|---|
| Unmodified Cloth | 0.68 | 0.96 | 0.94 | 1.03 |
| 1.0 | 0.70 | 1.08 | 1.07 | 1.12 |
| 2.8 | 0.71 | 1.12 | 1.15 | 1.20 |
| 4.3 | 0.80 | 1.23 | 1.25 | 1.33 |
| 8.0 | 0.90 | 1.28 | 1.30 | 1.40 |
| 10.0 | 0.92 | 1.30 | 1.32 | 1.56 |
| 14.4 | 0.91 | 1.30 | 1.31 | 1.54 |
| 15.2 | 0.90 | 1.29 | 1.29 | 1.54 |
| 20.0 | 0.78 | 1.20 | 1.24 | 1.30 |
| 24.8 | 0.68 | 0.98 | 0.97 | 1.05 |

*The amount of sodium hydroxide incorporated in the cloth, as expressed in terms of percentage by weight based on the weight of the cloth.

It can be seen from these data that, when the molar ratio of sodium hydroxide to p-toluenesulfonyl chloride incorporated in the cloth was fixed at 1.30, relatively good results were noted insofar as the amount of sodium hydroxide was within the range of from 1 to 20% by weight. Among others, satisfactory printed cloths suitable for practical use were obtained when the amount of sodium hydroxide was within the range of from 4.3 to 20.0% by weight.

EXAMPLE 5

(1) A modified cloth was obtained in the same manner as in Example 1. This modified cloth was soaked in a resin-treating fluid having the following composition, squeezed to give a pickup of 80%, predried at 100° C. for 2 minutes, and then baked at 150° C. for 3 minutes.

| (Resin-treating Fluid Composition) Ingredient | Parts by Weight |
|---|---|
| Sumitex Resin AMH3000 (an acrylic ester emulsion manufactured by Sumitomo | 10 |

-continued

| (Resin-treating Fluid Composition) Ingredient | Parts by Weight |
|---|---|
| Chemicals Co.) | |
| Sumitex Accelerator X-80 (a metal salt, manufactured by Sumitomo Chemials Co.) | 1 |
| Water | 90 |

(2) A transfer paper was prepared in the same manner as in Example 1.

(3) The transfer paper described in the above paragraph (2) was superposed on the modified cloth described in the above paragraph (1), and transfer printing was carried out by the application of heat and pressure to them. More specifically, they were exposed to a temperature of 195° C. and a pressure of 300 g/cm$^2$ for 40 seconds. This resulted in a printed cloth of which both the polyester and the cotton portion showed a red color of the same density, saturation, and depth. According to the JIS A-2 method for the measurement of color fastness to washing, this printed cloth was rated 5 and thus found to have excellent color fastness to washing. When the printed cloths subjected or not subjected to the resin treatment were tested by means of a Macbeth reflection densitometer, the density of the color was 1.32 for the former and 1.27 for the latter. This indicates that the resin treatment caused an increase in color density.

EXAMPLE 6

(1) Mercerized broad cloth composed of a 65/35 blend of polyester and cotton was soaked in an aqueous solution of 10% (w/w) sodium hydroxide for 30 seconds, squeezed to give a pickup of 100%, and then dried in an oven at 100° C. for 30 seconds. Thereafter, this cloth was soaked in a solution of 25% (w/w) o-nitrobenzenesulfonyl chloride in a 1:1 mixture of acetone and toluol for 30 seconds, squeezed to give a pickup of 100%, and then air-dried. The molar ratio of o-nitrobenzenesulfonyl chloride to sodium hydroxide incorporated in the cloth was 0.76. The cloth thus impregnated was treated with normal-pressure saturated steam at 100° C. for 3 minutes, washed with water, soaped, washed again with water, and then dried to obtain a modified cloth. The degree of substitution (D.S.) of this modified cloth was 0.18.

(2) A transfer paper was prepared in the same manner as in Example 1. (3) The transfer paper described in the above paragraph (2) was superposed on the modified cloth described in the above paragraph (1), and transfer printing was carried out by exposing them to a temperature of 195° C. and a pressure of 300 g/cm$^2$ for 40 seconds. This resulted in a printed cloth of which both the polyester and the cotton portion showed a red color of the same density.

(4) In the ink composition described in Example 1, the Sumikalon Red E-FBL was replaced by Aizen Catilon Red 6BH (a cationic type manufactured by Hodogaya Chemicals Co.) or Solvent Red 24. Then, transfer papers were prepared by gravure printing with the resulting inks and used to carry out transfer printing of the above modified cloth under the same conditions. In either case, both the polyester and the cotton portion of the printed cloth showed a red color of the same density. Moreover, an aqueous solution of a mordant dye was prepared and used to carry out dip dyeing of the above modified cloth. As a result, the cloth was colored to a similar density.

EXAMPLE 7

(1) Mercerized broad cloth composed of a 65/35 blend of polyester and cotton was soaked in an aqueous solution of 20% (w/w) sodium hydroxide for 2 minutes and then washed with water. Thereafter, this cloth was directly soaked in a solution of 30% (w/w) p-toluenesulfonyl chloride in acetone, squeezed to give a pickup of 80%, and then dried at 70° C. Moreover, this cloth was soaked in an aqueous solution of 2% (w/w) sodium hydroxide and then squeezed to give a pickup of 80%. As a result, the molar ratio of sodium hydroxide to p-toluenesulfonyl chloride incorporated in the cloth was 0.32. The cloth thus impregnated was baked in an oven at 140° C. for 3 minutes, washed with water, and then dried to obtain a modified cloth.

(2) A transfer paper was prepared by gravure printing of single starch-coated paper (having a basis weight of 60 g/m$^2$) with an ink having the following composition.

| (Ink Composition) Ingredient | Parts by Weight |
|---|---|
| Sumikalon Red E-FBL Power (a disperse dye manufactured by Sumitomo Chemicals Co.) | 10 |
| Ethyl Cellulose N-7 | 9 |
| Nonionic Surfactant (polyoxyethylene alkylarylether) | 1 |
| Isopropyl Alcohol | 40 |
| Ethanol | 40 |

(3) The transfer paper described in the above paragraph (1) was superposed on the modified cloth described in the above paragraph (2), and transfer printing was carried out by the application of heat and pressure to them. More specifically, they were exposed to a temperature of 200° C. and a pressure of 300 g/m$^2$ for 40 seconds. This resulted in a printed cloth of which both the polyester and the cotton portion showed a red color of the same density. According to the JIS A-2 method for the measurement of color fastness to washing, this printed cloth was rated 5 and thus found to have excellent color fastness to washing.

EXAMPLE 8

(1) A modified cloth was obtained in the same manner as in Example 7. This modified cloth was soaked in a cross-linking fluid having the following composition, squeezed to give a pickup of 80%, predried at 100° C. for 2 minutes, and then baked at 150° C. for 3 minutes.

| (Cross-linking Fluid Composition) Ingredient | Parts by Weight |
|---|---|
| Sumitex Resin NS-16 (methylolglyoxal cross-linking agent manufactured by Sumitomo Chemicals Co.) | 10 |
| Sumitex Accelerator X-80 (a metal salt, manufactured by Sumitomo Chemical Co.) | 1 |
| Sumitex Softener L (manufactured by Sumitomo Chemicals Co.) | 1 |
| Water | 90 |

(2) A transfer paper was prepared in the same manner as in Example 7.

(3) The transfer paper described in the above paragraph (2) was superposed on the modified cloth described in the above paragraph (1), and transfer printing was carried out by the application of heat and pressure to them. More specifically, they were exposed to a temperature of 200° C. and a pressure of 300 g/cm$^2$ for 40 seconds. This resulted in a printed cloth of which both the polyester and the cotton portion showed a red color of the same density and which had an excellent feeling. When the printed cloths subjected and not subjected to the cross-linking treatment were tested by means of a Macbeth reflection densitometer, the density of the color was 1.20 for the former and 1.08 for the latter. This indicates that the cross-linking treatment caused an increase in color density.

EXAMPLE 9

(1) A modified cloth was obtained in the same manner as in Example 7. This modified cloth was soaked in a resin-treating fluid having the following composition, squeezed to give a pickup of 80%, predried at 100° C. for 2 minutes, and then baked at 150° C. for 3 minutes.

| (Resin-treating Fluid Composition) Ingredient | Parts by Weight |
|---|---|
| Sumitex Resin AMH3000 (an acrylic ester emulsion manufactured by Smitomo Chemicals Co.) | 10 |
| Sumitex Accelerator X-80 (manufactured by Sumitomo Chemicals Co.) | 1 |
| Water | 90 |

(2) A transfer paper was prepared in the same manner as in Example 7.

(3) The transfer paper described in the above paragraph (2) was superimposed on the modified cloth described in the above paragraph (1), and transfer printing was carried out by the addition of heat and pressure to them. More specifically, they were exposed to a temperature of 200° C. and a pressure of 300 g/cm$^2$ for 40 seconds. This resulted in a printed cloth of which both the polyester and the cotton portion showed a red color of the same density, saturation, and depth. According to the JIS A-2 method for the measurement of color fastness to washing, this printed cloth was rated 5 and thus found to have excellent color fastness to washing. When the printed cloths subjected and not subjected to the resin treatment were tested by means of a Macbeth reflection densitometer, the density of the color was 1.28 for the former and 1.03 for the latter. This indicates that the resin treatment caused a marked increase in color density.

The following Examples 10 to 15 illustrate the practice of the present invention according to the aforesaid procedure 4-(iii).

EXAMPLE 10

(1) Employing the system shown in FIG. 2, chemical modification was carried out as follows: Mercerized broad cloth composed of a 65/35 blend of polyester and cotton was soaked in an aqueous solution of 20% (w/w) sodium hydroxide for 30 seconds, squeezed by means of squeeze rolls to give a pickup of 100%, and then dried by allowing it to reside in a pin tenter oven at 100° C. for 40 seconds. Thereafter, this cloth was soaked in a solution of 30% (w/w) p-toluenesulfonyl chloride in acetone for 30 seconds, squeezed to give a pickup of 100%, and then air-dried. Moreover, this cloth was soaked in an aqueous solution of 5% (w/w) sodium hydroxide for 3 minutes, squeezed to give a pickup of 100%, and then dried by allowing it to reside in a pin tenter oven at 100° C. for 25 seconds. As a result, the molar ratio of sodium hydroxide to p-toluenesulfonyl chloride incorporated in the cloth was 1.25. The cloth thus impregnated was treated with normal-pressure saturated steam at 100° C. for 3 minutes, washed with water, soaped with marseilles soap, washed again with water, and then dried to obtain a modified cloth.

(2) A transfer paper was prepared by gravure printing of single starch-coated paper (having a basis weight of 60 g/m$^2$) with an ink having the following composition.

| (Ink Composition) Ingredient | Parts by Weight |
|---|---|
| Sumikalon Red E-FBL Power (a disperse dye manufactured by Sumitomo Chemicals Co.) | 10 |
| Ethyl Cellulose N-7 | 9 |
| Nonionic Surfactant (polyoxyethylene alkylarylether) | 1 |
| Isopropyl Alcohol | 40 |
| Ethanol | 40 |

(3) The transfer paper described in the above paragraph (2) was superposed on the modified cloth described in the above paragraph (1), and transfer printing was carried out by the application of heat and pressure to them. More specifically, they were exposed to a temperature of 195° C. and a pressure of 300 g/cm$^2$ for 40 seconds. This resulted in a printed cloth of which both the polyester and the cotton portion showed a red color of the same density. According to the JIS A-2 method for the measurement of color fastness to washing, this printed cloth was rated 5 and thus found to have excellent color fastness to washing.

EXAMPLE 11

A printed cloth was obtained in the same manner as in Example 10. In this example, however, the impregnated cloth was baked in a hot-air oven at 130° C. for 3 minutes instead of being treated with normal-pressure saturated steam at 100° C. for 3 minutes. When the printed cloths obtained in Examples 10 and 11 were tested by means of a Macbeth reflection densitometer, the density of the color was 1.30 for the former and 1.05 for latter. This indicates that the steaming produced a better modifying effect.

EXAMPLE 12

(1) A modified cloth was obtained in the same manner as in Example 11. This modified cloth was soaked in a resin-treating fluid having the following composition, squeezed to give a pickup of 80%, predried at 100° C. for 2 minutes, and then baked at 150° C. for 3 minutes.

| (Resin-treating Fluid Composition) Ingredient | Parts by Weight |
|---|---|
| Sumitex Resin AMH3000 (an acrylic ester emulsion manufactured by Smitomo Chemicals Co.) | 10 |
| Sumitex Accelerator X-80 (manufactured by Sumitomo Chemicals Co.) | 1 |

-continued

| (Resin-treating Fluid Composition) Ingredient | Parts by Weight |
|---|---|
| Water | 90 |

(2) A transfer paper was prepared in the same manner as in Example 10.

(3) The transfer paper described in the above paragraph (2) was superposed on the modified cloth described in the above paragraph (1), and transfer printing was carried out by the application of heat and pressure to them. More specifically, they were exposed to a temperature of 195° C. and a pressure of 300 g/cm$^2$ for 40 seconds. This resulted in a printed cloth of which both the polyester and the cotton portion showed a red color of the same density, saturation, and depth. According to the JIS A-2 method for the measurement of color fastness to washing, this printed cloth was rated 5 and thus found to have excellent color fastness to washing. When the printed cloths subjected and not subjected to the resin treatment were tested by means of a Macbeth reflection densitometer, the density of the color was 1.28 for the former and 1.05 for the latter. This indicates that the resin treatment caused a marked increase in color density.

EXAMPLE 13

(1) A modified cloth was obtained in the same manner as in Example 10. This modified cloth was soaked in a cross-linking fluid having the following composition, squeezed to give a pickup of 80%, predried at 100° C. for 2 minutes, and then baked at 150° C. for 3 minutes.

| (Cross-linking Fluid Composition) Ingredient | Parts by Weight |
|---|---|
| Sumitex Resin NS-16 (manufactured by Sumitomo Chemicals Co.) | 10 |
| Sumitex Accelerator X-80 (manufactured by Sumitomo Chemicals Co.) | 1 |
| Sumitex Softener L (manufactured by Sumitomo Chemicals Co.) | 1 |
| Water | 90 |

(2) A transfer paper was prepared in the same manner as in Example 10.

(3) The transfer paper described in the above paragraph (2) was superposed on the modified cloth described in the above paragraph (1), and transfer printing was carried out by the application of heat and pressure to them. More specifically, they were exposed to a temperature of 200° C. and a pressure of 300 g/cm$^2$ for 40 seconds. This resulted in a printed cloth of which both the polyester and the cotton portion showed a red color of the same density and which had an excellent feeling.

EXAMPLE 14

(1) Mercerized broad cloth composed of a 65/35 blend of polyester and cotton was soaked in an aqueous solution of 20% (w/w) sodium hydroxide for 30 seconds, squeezed to give a pickup of 100%, and then dried in an oven at 100° C. for 40 seconds. Thereafter, this cloth was soaked in a solution of 25% (w/w) o-nitrobenzenesulfonyl chloride in a 1:1 mixture of acetone and toluol for 30 seconds, squeezed to give a pickup of 100%, and then air-dried. Moreover, this cloth was soaked in an aqueous solution of 15% (w/w) magnesium acetate for 3 minutes, squeezed to give a pickup of 100%, and then dried in an oven at 100° C. for 25 seconds. The cloth thus impregnated was treated with high-pressure saturated steam at 130° C. for 10 minutes, washed with water, soaped, washed again with water, and then dried to obtain a modified cloth.

(2) A transfer paper for sublimation transfer printing (manufactured by Toppan Printing Co.) was superposed on the modified cloth described in the above paragraph (1), and transfer printing was carried out by the application of heat and pressure to them. More specifically, they were exposed to a temperature of 195° C. and a pressure of 300 g/cm$^2$ for 40 seconds. This resulted in a beautiful printed cloth.

EXAMPLE 15

A modified cloth was obtained in the same manner as in Example 10. According to the silk screen process, this modified cloth was directly printed with a textile printing ink having the following composition, treated with high-pressure saturated steam at 130° C. for 20 minutes, washed with water, soaped, washed again with water, and then dried to obtain a beautiful printed cloty.

| (Textile Printing Ink Composition) Ingredient | Parts by Weight |
|---|---|
| Resolin Blue FBL (a dye manufactured by Bayer A.G.) | 6 |
| Sodium Alginate | 7 |
| Water | 87 |

The following Examples 16 to 19 illustrate the practice of the present invention according to the aforesaid procedures 4-(iv).

EXAMPLE 16

(1) A solution of 40% (w/w) p-toluenesulfonyl chloride in toluene was prepared and then microcapsulated. The resulting microcapsules contained the p-toluenesulfonyl chloride solution in an amount of 70% by weight based on the total weight of the microcapsules.

(2) In an aqueous solution of 5% (w/w) sodium hydroxide, 50% by weight of the microcapsules described in the above paragraph (1) were mixed and dispersed uniformly with the aid of a stirrer. The molar ratio of sodium hydroxide to p-toluenesulfonyl chloride present in this impregnating fluid was about 1.7.

(3) One surface of mercerized broad cloth composed of a 65/35 blend of polyester and cotton was roll-coated with the impregnating fluid described in the above paragraph (2), whereby 100% by weight of the impregnating fluid was applied to the cloth. The cloth thus impregnated was dried by allowing it to reside in a pin tenter oven at 60° C. for 40 seconds, treated with normal-pressure saturated steam at 100° C. for 3 minutes, washed with water, soaped with marseilles soap, washed again with water, and then dried to obtain a modified cloth.

(4) A transfer paper was prepared by gravure printing of single starch-coated paper (having a basis weight of 60 g/m$^2$) with an ink having the following composition.

| (Ink Composition) Ingredient | Parts by Weight |
|---|---|
| Sumikalon Red E-FBL Power (a disperse dye manufactured by Sumitomo Chemicals Co.) | 10 |
| Ethyl Cellulose N-7 | 9 |
| Nonionic Surfactant (polyoxyethylene alkylarylether) | 1 |
| Isopropyl Alcohol | 40 |
| Ethanol | 40 |

(5) The transfer paper described in the above paragraph (4) was superposed on the modified cloth described in the above paragraph (3), and transfer printing was carried out by the application of heat and pressure to them. More specifically, they were exposed to a temperature of 195° C. and a pressure of 300 g/cm$^2$ for 40 seconds. This resulted in a printed cloth of which both the polyester and the cotton portion showed a red color of the same density. According to the JIS A-2 method for the measurement of color fastness to washing, this printed cloth was rated 5 and thus found to have excellent color fastness to washing.

EXAMPLE 17

(1) A modified cloth was obtained in the same manner as in Example 16. This modified cloth was soaked in a resin-treating fluid having the following composition, squeezed to give a pickup of 80%, predried at 100° C. for 2 minutes, and then baked at 150° C. for 3 minutes.

| (Resin-treating Fluid Composition) Ingredient | Parts by Weight |
|---|---|
| Sumitex Resin AMH3000 (an acrylic ester emulsion manufactured by Smitomo Chemicals Co.) | 10 |
| Sumitex Accelerator X-80 (manufactured by Sumitomo Chemicals Co.) | 1 |
| Water | 90 |

(2) A transfer paper was prepared in the same manner as in Example 16.

(3) The transfer paper described in the above paragraph (2) was superposed on the modified cloth described in the above paragraph (1), and transfer printing was carried out by the application of heat and pressure to them. More specifically, they were exposed to a temperature of 195° C. and a pressure of 300 g/cm$^2$ for 40 seconds. This resulted in a printed cloth of which both the polyester and the cotton portion showed a red color of the same density, saturation, and depth. According to the JIS A-2 method for the measurement of color fastness to washing, this printed cloth was rated 5 and thus found to have excellent color fastness to washing. When the printed cloths subjected and not subjected to the resin treatment were tested by means of a Macbeth reflection densitometer, the density of the color was 1.28 for the former and 1.20 for the latter. This indicates that the resin treatment caused a marked increase in color density.

EXAMPLE 18

A printed cloth was obtained in the same manner as in Example 16. In this example, however, the impregnated cloth was baked in a hot-air oven at 130° C. for 3 minutes instead of being treated with normal-pressure saturated steam at 100° C. for 3 minutes. When the printed cloths obtained in Examples 16 and 18 were tested by means of a Macbeth reflection densitometer, the density of the color was 1.20 for the former and 1.05 for the latter. This indicates that the steaming produced a better modifying effect.

EXAMPLE 19

(1) An aqueous solution of sodium hydroxide was prepared and then microcapsulated. The resulting microcapsules contained sodium hydroxide in an amount of 70% by weight based on the total weight of the microcapsules.

(2) In a solution of 20% (w/w) p-toluenesulfonyl chloride in toluene, 25% by weight of the microcapsules described in the above paragraph (1) were mixed and dispersed uniformly with the aid of a stirrer. The molar ratio of sodium hydroxide to p-toluenesulfonyl chloride present in this impregnating fluid was about 1.8.

(3) In the same manner as in Example 16, one surface of mercerized cambric cloth composed of a 65/35 blend of polyester and cotton was roll-coated with the impregnating fluid described in the above paragraph (2), whereby 100% by weight of the impregnating fluid was applied to the cloth. The cloth thus impregnated was air-dried in a pin tenter oven at 25° C., treated with normal-pressure saturated steam at 100° C. for 3 minutes, washed with water, soaped, washed again with water, and then dried to obtain a modified cloth. Transfer printing of this modified cloth was carried out in the same manner as in Example 16 to obtain a beautiful printed cloth.

The following Examples 20 to 26 illustrate the utilization of compounds capable of inactivating hydrogen chloride.

EXAMPLE 20

(1) Employing the system shown in FIG. 2, chemical modification was carried out as follows: Mercerized broad cloth composed of a 65/35 blend of polyester and cotton was soaked in an aqueous solution of 20% (w/w) sodium hydroxide for 30 seconds, squeezed by means of squeeze rolls to give a pickup of 100%, and then dried by allowing it to reside in a pin tenter oven at 100° C. for 40 seconds. Thereafter, this cloth was soaked in a solution of 30% (w/w) p-toluenesulfonyl chloride and 20% (w/w) Nissan Epiol B (butyl glycidyl ether manufactured by Nippon Fats & Oils Co.) in acetone for 30 seconds, squeezed to give a pickup of 100%, and then air-dried. Moreover, this cloth was soaked in an aqueous solution of 5% (w/w) sodium hydroxide for 3 minutes, squeezed to give a pickup of 100%, and then dried by allowing it to reside in a pin tenter oven at 100° C. for 25 seconds. The cloth thus impregnated was treated with normal-pressure saturated steam at 100° C. for 3 minutes, washed with water, soaped with marseilles soap, washed again with water, and then dried to obtain a modified cloth. As a result of the addition of butyl glycidyl ether, the evolution of hydrogen chloride during the steaming was suppressed. Without its addition, the cloth having just emerged from the steamer showed a pH value of 2. With its addition, however, the cloth having just emerged from the steamer showed a pH value of 11 and the steam escaping from the steamer was always neutral.

(2) A transfer paper was prepared by gravure printing of single starch-coated paper (having a basis weight of 60 g/m$^2$) with an ink having the following composition.

| (Ink Composition) Ingredient | Parts by Weight |
|---|---|
| Sumikalon Red E-FBL Power (a disperse dye manufactured by Sumitomo Chemicals Co.) | 10 |
| Ethyl Cellulose N-7 | 9 |
| Nonionic Surfactant (polyoxyethylene alkylarylether) | 1 |
| Isopropyl Alcohol | 40 |
| Ethanol | 40 |

(3) The transfer paper described in the above paragraph (2) was superposed on the modified cloth described in the above paragraph (1), and transfer printing was carried out by the application of heat and pressure to them. More specifically, they were exposed to a temperature of 195° C. and a pressure of 300 g/cm$_2$ for 40 seconds. This resulted in a printed cloth of which both the polyester and the cotton portion showed a red color of the same density. According to the JIS A-2 method for the measurement of color fastness to washing, this printed cloth was rated 5 and thus found to have excellent color fastness to washing.

EXAMPLE 21

(1) Mercerized cambric cloth composed of a 65/35 blend of polyester and cotton was soaked in an aqueous solution of 10% (w/w) sodium hydroxide for 20 seconds, squeezed by means of squeeze rolls to give a pickup of 100%, and then dried by allowing it to reside in a pin tenter oven at 100° C. for 40 seconds. Thereafter, this cloth was soaked in a solution of 30% (w/w) p-toluene-sulfonyl chloride and 10% (w/w) Mark BT-31 (a dibutyltin maleate-based hydrogen chloride trapping agent manufactured by Adeca-Argus Co.) in acetone for 20 seconds, squeezed to give a pickup of 120%, and then air-dried. The cloth thus impregnated was treated with normal-pressure saturated steam at 100° C. for 3 minutes, washed with water, soaped with marseilles soap, washed again with water, and then dried to obtain a modified cloth. As a result of the addition of the dibutyltin maleate-based hydrogen chloride trapping agent, the evolution of hydrogen chloride during the steaming was suppressed. More specifically, as in Example 20, the cloth having just emerged from the steamer showed an alkaline pH and the steam escaping from the steamer was always neutral.

(2) The transfer paper described in the paragraph (2) of Example 20 was superposed on the modified cloth described in the above paragraph (1), and transfer printing was carried out by exposing them to a temperature of 195° C. and a pressure of 300 g/cm$^2$ for 40 seconds. This resulted in a very beautiful printed cloth.

EXAMPLE 22

(1) Mercerized broad cloth composed of a 65/35 blend of polyester and cotton was soaked in an aqueous solution of 10% (w/w) sodium hydroxide and 15% (w/w) ammonium acetate for 20 seconds, squeezed by means of squeeze rolls to give a pickup of 100%, and then dried by allowing it to reside in a pin tenter oven at 100° C. Thereafter, this cloth was soaked in a solution of 30% (w/w) p-toluenesulfonyl chloride and 10% (w/w) Mark AC-141 (Ba-Zn compound metallic soap manufactured by Adeca-Argus Co.) in methyl ethyl ketone for 20 seconds, squeezed to give a pickup of 120%, and then air-dried. The cloth thus impregnated was treated with normal-pressure saturated steam at 100° C. for 3 minutes, washed with water, soaped, washed again with water, and then dried to give a modified cloth. As a result of the addition of ammonium acetate and Ba-Zn compound metallic soap, the cloth having just emerged from the steamer showed an alkaline pH and the steam escaping from the steamer was neutral or alkaline and had a faint ammoniacal odor.

(2) Transfer printing of the modified cloth described in the above paragraph (1) was carried out in the same manner as in Example 21. This resulted in a beautiful printed cloth.

EXAMPLE 23

(1) A modified cloth was obtained in the same manner as in Example 21. This modified cloth was soaked in a resin-treating fluid having the following composition, squeezed to give a pickup of 80%, predried at 100° C. for 2 minutes, and then baked at 150° C. for 3 minutes.

| (Resin-treating Fluid Composition) Ingredient | Parts by Weight |
|---|---|
| Sumitex Resin AMH3000 (an acrylic ester emulsion manufactured by Smitomo Chemicals Co.) | 10 |
| Sumitex Accelerator X-80 (manufactured by Sumitomo Chemicals Co.) | 1 |
| Water | 90 |

(2) A transfer paper was prepared in the same manner as in Example 20.

(3) The transfer paper described in the above paragraph (2) was superposed on the modified cloth described in the above paragraph (1), and transfer printing was carried out by the application of heat and pressure to them. More specifically, they were exposed to a temperature of 195° C. and a pressure of 300 g/cm$^2$ fof 40 seconds. This resulted in a printed cloth of which both the polyester and the cotton portion showed a red color of the same density, saturation, and depth. According to the JIS A-2 method for the measurement of color fastness to washing, this printed cloth was rated 5 and thus found to have excellent color fastness to washing. When the printed cloths subjected and not subjected to the resin treatment were tested by means of a Macbeth reflection densitometer, the density of the color was 1.28 for the former and 1.05 for the latter. This indicates that the resin treatment caused a marked increase in color density.

EXAMPLE 24

(1) A modified cloth was obtained in the same manner as in Example 20. This modified cloth was soaked in a resin-treating fluid having the following composition, squeezed to give a pickup of 80%, predried at 100° C. for 2 minutes, and then baked at 150° C. for 3 minutes.

| (Resin-treating Fluid Composition) Ingredient | Parts by Weight |
|---|---|
| Sumitex Resin NS-16 (manufactured by Sumitomo Chemicals Co.) | 10 |
| Sumitex Accelerator X-80 (manufactured by Sumitomo Chemicals Co.) | 1 |
| Sumitex Softener L (manufactured by Sumitomo Chemicals Co.) | 1 |
| Water | 90 |

(2) A transfer paper was prepared in the same manner as in Example 20.

(3) The transfer paper described in the above paragraph (2) was superposed on the modified cloth described in the above paragraph (1), and transfer printing was carried out by the application of heat and pressure to them. More specifically, they were exposed to a temperature of 200° C. and a pressure of 300 g/cm$^2$ for 40 seconds. This resulted in a printed cloth of which both the polyester and the cotton portion showed a red color of the same density and which had an excellent feeling.

EXAMPLE 25

A modified cloth was obtained in the same manner as in Example 20. According to the silk screen process, this modified cloth was directly printed with a textile printing ink having the following composition, treated with high-pressure saturated steam at 130° C. for 20 minutes, washed with water, soaped, washed again with water, and then dried to obtain a very beautiful printed cloth.

| (Textile Printing Ink Composition) Ingredient | Parts by Weight |
|---|---|
| Resolin Blue FBL (a dye manufactured by Bayer A.G.) | 6 |
| Sodium Alginate | 7 |
| Water | 87 |

EXAMPLE 26

A printed cloth was obtained in the same manner as in Example 20. In this example, however, the impregnated cloth was baked in a hot-air oven at 130° C. for 3 minutes instead of being treated with normal-pressure saturated steam at 100° C. for 3 minutes. When the printed cloths obtained in Examples 20 and 26 were tested by means of a Macbeth reflection densitometer, the density of the color was 1.30 for the former and 1.05 for the latter. This indicates that the steaming produced a better modifying effect.

EXAMPLE 27

(1) Broad cloth (having a weight per unit area of 100 g/m$^2$) composed of a 65/35 blend of polyester and cotton was uniformly impregnated with 8.2% by weight of sodium hydroxide and then with 30% by weight of p-toluenesulfonyl chloride. The molar ratio of sodium hydroxide to p-toluenesulfonyl chloride incorporated in the cloth was 1.3. The cloth thus impregnated was treated with normal-pressure saturated steam at 100° C. for 2 minutes, washed with water, soaped with marseilles soap, washed again with water, and then dried to obtain a modified cloth. The amount of steam used was $6\times10^6$ ml per 100 g of the cloth, and the degree of substitution (D.S.) of the modified cloth as determined by the weight increase method was 0.24. It was experimentally demonstrated that 0.03 mole of hydrogen chloride was released from 30 g of p-toluenesulfonyl chloride incorporated in every 100 g of the cloth and mixed in $6\times10^6$ ml of steam. The condensate of this steam showed a pH value of 2.

(2) On the occasion of steaming, a sonic nozzle (available from Ikeuchi Co. under the trade name of Sonicore) as shown in FIG. 4 was used to add very small amounts of ammonia to steam. In other respects, the cloth was treated in the same manner as in the above paragraph (1). The results thus obtained are summarized in the following table.

| Amount of Ammonia Added to Steam (ppm) | pH Value of Steam Condensate |
|---|---|
| 1.0 × 1,200 | 9 |
| 0.67 × 1,200 | 8 |
| 0.5 × 1,200 | 8 |
| 0.3 × 1,200 | 7 |
| 0.17 × 1,200 | 2–3 |

As can be seen from these data, the steam showed an acid pH when the amount of ammonia added to steam was from 0 to 0.17×1,200 ppm. However, when the amount of ammonia was from 0.3×1,200 to 1.0×1,200 ppm, the steam showed a neutral or alkaline pH whereby the problem of corrosion of the steamer (made of stainless steel SUS304) could be solved. Moreover, the degree of substitution (D.S.) of the modified cloth remained at about 0.24 regardless of the addition of ammonia, indicating that the presence of ammonia has no adverse effect on the tosylation reaction. Then, a transfer paper for sublimation transfer printing (manufactured by Toppan Printing Co. and composed mainly of a disperse dye) was superposed on each of the modified cloths thus obtained, and transfer printing was carried out by exposing them to a temperature of 195° C. and a pressure of 100 g/m$^2$ for 35 seconds. This resulted in a beautiful printed color of which both the polyester and the cotton portion were colored uniformly.

(3) The modified cloths obtained in the above paragraphs (1) and (2) were tested for Elmendorf tear strength. The results thus obtained are summarized in the following table.

| Amount of Ammonia Added to Steam (ppm) | pH Value of Steam Condensate | Elmendorf Tear Strength (g) |
|---|---|---|
| 0 | 2 | 1,013 |
| 0.5 × 1,200 | 8 | 1,340 |
| 1.0 × 1,200 | 9 | 1,326 |

As can be seen from these data, the modified cloth treated with steam containing hydrogen chloride showed a reduction in strength. However, such a reduction in strength was prevented when the steam was made neutral or weakly alkaline by the addition of ammonia.

What we claim is:

1. A method of dyeing a fiber structure composed of a cellulose fiber or a blend of cellulose fiber and a synthetic fiber which comprises the steps of impregnating the fiber structure with an alkaline compound in an amount of from 1 to 20% by weight based on the weight of the fiber structure and with a modifying agent, the molar ratio of the alkaline compound to the modifying agent being 0.1 to 2.0, and the modifying agent being a compound of the formula

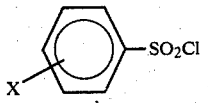

where X is —H, —$NO_2$, —$CH_3$, or —$SO_2Cl$; effecting chemical modification of the impregnated fiber structure by heat-treating it under steaming conditions at a temperature of from about 100° to 180° C. or dry heating conditions at a temperature of from about 60° to 180° C. for a time period not exceeding 20 minutes; and then dyeing the modified fiber structure with a dye selected from the group consisting of a disperse dye, an oil-soluble dye, a mordant dye, and a basic dye.

2. A method as claimed in claim 1 wherein, prior to the chemical modification, the fiber structure is first impregnated with the alkaline compound and then with the modifying agent.

3. A method as claimed in claim 1 wherein, prior to the chemical modification, the fiber structure is first impregnated with the modifying agent and then with the alkaline compound.

4. A method as claimed in claim 1 wherein, prior to the chemical modification, the fiber structure is first impregnated with the alkaline compound, then with the modifying agent, and again with the alkaline compound.

5. A method as claimed in claim 1 wherein the alkaline compound or the modifying agent or both are microcapsulated and, prior to the chemical modification, the fiber structure is simultaneously impregnated with the alkaline compound and the modifying agent.

6. A method as claimed in any one of claims 1–5 wherein the chemical modification is effected by treating the impregnated fiber structure with normal-pressure saturated steam or superheated steam at a temperature of from 100° to 180° C.

7. A method as claimed in any one of claims 1–5 wherein the chemical modification is effected by treating the impregnated fiber structure with high-pressure saturated steam at a temperature of from 100° to 140° C.

8. A method as claimed in any one of claims 1–5 wherein the chemical modification is effected by baking the impregnated fiber structure at a temperature of from 60° to 180° C.

9. A method as claimed in any one of claims 1–5 wherein the modified fiber structure is dyed by direct printing.

10. A method as claimed in any one of claims 1–5 wherein the modified fiber structure is dyed by transfer printing.

11. A method as claimed in any one of claims 1–5 wherein the impregnated fiber structure is heat-treated in the presence of a compound capable of inactivating hydrogen chloride.

12. A method as claimed in claim 11 wherein the compound capable of inactivating hydrogen chloride is ammonia or an ammonium salt.

13. A method as claimed in claim 11 wherein the compound capable of inactivating hydrogen chloride is a metallic soap of the formula $$M(OOCR)_2$$

or $$Al(OOCR)_2OH$$

where M is a metal such as Ca, Ba, Zn, Sn, Mg, Cd, or Pb and R is an alkyl group.

14. A method as claimed in claim 11 wherein the compound capable of inactivating hydrogen chloride is an organotin compound of the formula

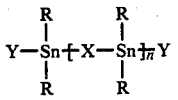

where n is zero or a positive integer, R is an alkyl group, Y is $R_1COO$—, $R_2OOC$—C═C—COO—, $R_3S$—, or $R_4OOC$—$CH_2$—S—, and $R_1$, $R_2$, $R_3$, and $R_4$ are alkyl groups.

15. A method as claimed in claim 11 wherein the compound capable of inactivating hydrogen chloride is an epoxy compound.

* * * * *